United States Patent [19]

Stumpp et al.

[11] Patent Number: 4,811,711

[45] Date of Patent: Mar. 14, 1989

[54] FUEL INJECTION PUMP FOR INTERNAL COMBUSTION ENGINES

[75] Inventors: Gerhard Stumpp, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 212,997

[22] Filed: Jun. 29, 1988

[30] Foreign Application Priority Data

Jul. 29, 1987 [DE] Fed. Rep. of Germany ..... 3725089

[51] Int. Cl.[4] ..... F02M 39/00

[52] U.S. Cl. ..... 123/359; 123/198 DB; 123/387

[58] Field of Search ..... 123/498, 387, 479, 198 DB, 123/359, 357, 358, 386, 385, 198 D

[56] References Cited

U.S. PATENT DOCUMENTS

| | | | |
|---|---|---|---|
| 2,902,019 | 9/1959 | Aldinger | 123/387 |
| 3,587,540 | 6/1971 | Hofmann | 123/357 |
| 3,656,465 | 4/1972 | Frakle | 123/198 DB |
| 3,724,430 | 4/1973 | Adler | 123/357 |
| 3,841,291 | 10/1974 | Ludewig | 123/198 DB |
| 3,978,837 | 9/1976 | Lunberg | 123/357 |
| 4,209,000 | 6/1980 | Iuie | 123/198 DB |
| 4,296,718 | 10/1981 | Baugh | 123/387 |
| 4,319,550 | 3/1982 | Ishii | 123/198 DB |
| 4,361,121 | 11/1982 | Clemens et al. | 123/198 DB |
| 4,565,170 | 1/1986 | Grieshaber et al. | 123/359 |
| 4,680,711 | 7/1987 | Miyawaki | 123/198 DB |
| 4,741,306 | 5/1988 | Watanabe | 123/198 DB |

FOREIGN PATENT DOCUMENTS

| | | | |
|---|---|---|---|
| 3014712 | 10/1981 | Fed. Rep. of Germany | 123/359 |
| 3304335 | 8/1984 | Fed. Rep. of Germany | 123/359 |
| 0047630 | 4/1981 | Japan | 123/359 |

*Primary Examiner*—Carl Stuart Miller

*Attorney, Agent, or Firm*—Edwin E. Greigg

[57] ABSTRACT

A fuel injection pump for internal combustion engines, in particular an in-line injection pump for Diesel engines, is proposed having an injection quantity governor and an electrically driven feed pump, in which in order to assure an emergency shutoff in the event of a malfunction of the injection quantity governor, a check valve, the forward flow direction of which is toward a suction chamber filled with fuel by the feed pump, is disposed between the pressure-side outlet of the feed pump and the suction chamber. An emergency shutoff device responding to a malfunction switches off the feed pump drive, so that because of the lack of feed pressure the check valve closes and blocks off the suction chamber. The engine comes to a stop, as soon as a partial vacuum is established in the suction chamber, which occurs as soon as several revolutions later.

10 Claims, 1 Drawing Sheet

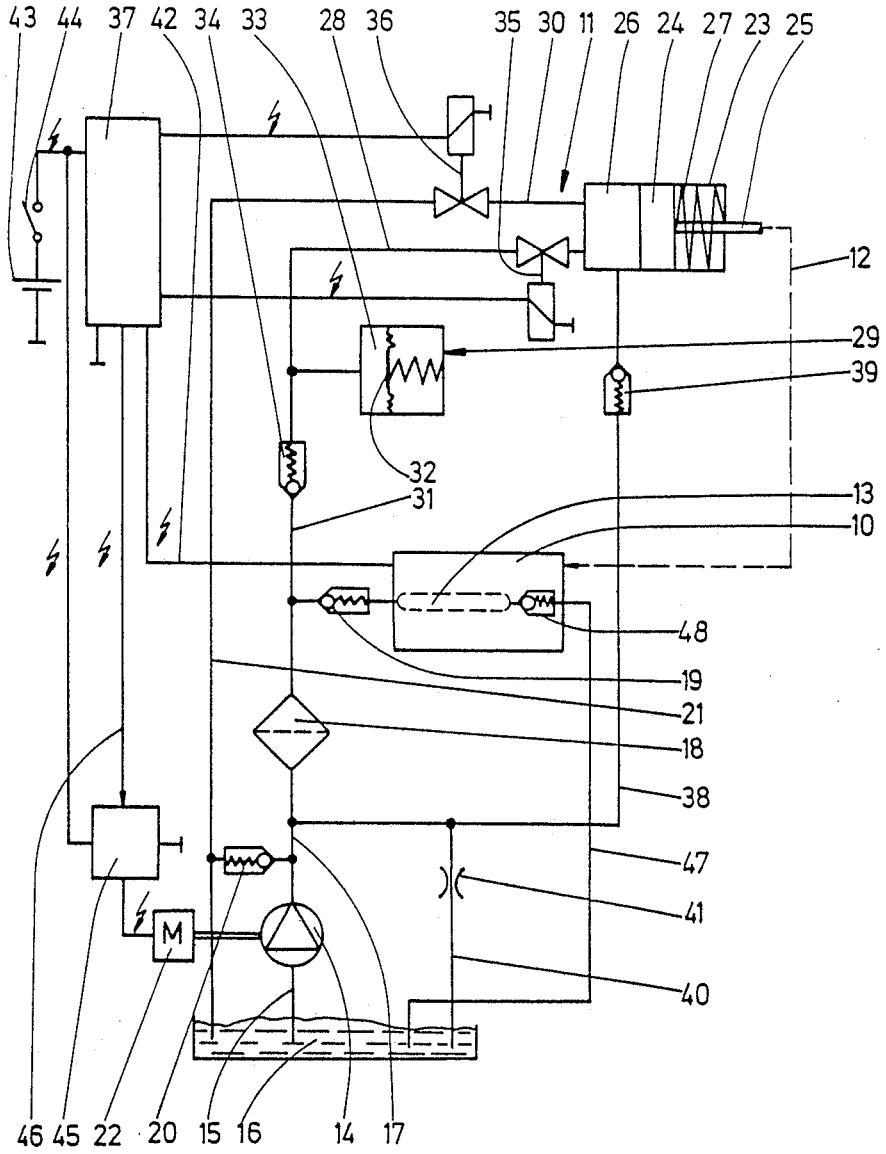
43
44
37
42
34
33
28
36
35
30
11
26
24
27
23
25
12
29
39
32
31
13
10
48
19
21
18
38
47
41
40
M
46
45
22
20
15
16
14
17

FUEL INJECTION PUMP FOR INTERNAL COMBUSTION ENGINES

BACKGROUND OF THE INVENTION

The invention is directed to improvements in a fuel injection pump for internal combustion engines, in particular an in-line injection pump for Diesel engines.

In a known fuel injection pump of this type (German Offenlegungsschrift No. 33 04 335), the fuel feed pump is embodied with a reversible direction of rotation, and an electrically controllable switching valve that is closed when without electric current is incorporated into the pressure line between the feed pump and the suction chamber. Additionally, the feed pump communicates on the pressure side with the suction chamber via a second switching valve that is closed when without electric current. The switching signal arising at the output of the emergency shutoff device if there is a malfunction in the injection quantity governor causes de-excitation of the first switching valve and the supplying of current to the second switching valve, so that the inlet to the suction chamber is blocked and the second connection between the suction chamber and the feed pump is opened up. The switching signal also causes a reversal of polarity of the feed pump drive, reversing the feed direction of the feed pump. Fuel is now aspirated from the suction chamber by the feed pump via the open second connection. Check valves in the pressure line to the suction chamber and in the intake line from the fuel tank as well as in the second connection to the suction chamber and in a further connection to the fuel tank assure that the fuel aspirated out of the suction chamber flows back into the fuel tank. Once the suction chamber is evacuated, the plunger of the fuel injection pump cannot feed any fuel during the intake stroke, and the engine stops.

The problem with this known pump is that providing the circuitry for the emergency shutoff of the engine in the event of malfunction of the injection quantity governor is relatively expensive in engineering time and effort.

OBJECT AND SUMMARY OF THE INVENTION

It is a principal object of the fuel injection pump according to the invention to provide the advantage over the prior art of assuring an emergency shutoff of the engine in the event of malfunctions in the injection quantity governor at relatively little engineering expense. All that is needed, besides the emergency shutoff device that responds to a malfunction in the injection quantity governor and is necessary in any event, is a check valve. If the feed pump is shut off by the emergency shutoff device, then the lack of feed pressure closes the check valve, and the supply of fuel to the suction chamber is interrupted. As soon as the pump plunger has partially evacuated the suction chamber, which happens after only a few revolutions, the engine stops from lack of fuel. Even though the time lag from the occurrence of the shutoff signal until the stoppage of the engine is longer than in the known fuel injection pump, it is still within an acceptable order of magnitude. The savings in terms of manufacturing costs is considerable, by comparison with the known pump.

In an injection quantity governor with a hydraulic final control element, the fuel reservoir is prevented from refilling the suction chamber with fuel if the feed pump is shut off, which refilling action otherwise would tend to lengthen the delay before engine shutoff, by a check valve disposed upstream of the fuel reservoir.

Via a connecting line having a check valve between the control chamber of the final control element and the pressure side of the feed pump, and by means of the bypass throttle between the pressure side of the feed pump and the fuel tank, the return of the final control element to its zero or stop position in the event of the emergency shutoff is assured. This happens because the control chamber is relieved via the check valve that opens in the absence of feed pressure, and by means of the restoring spring, the control plunger returns, expelling fuel in so doing, to its basic position, in which the control chamber volume is minimal. When the fuel injection pump is functioning properly, the connection between the control chamber and the fuel tank is blocked, because the feed pressure built up by the feed pump prevents opening of the check valve or flutter valve and hence blocks the forward flow direction. Only once the feed pressure is absent, when the feed pump is shut off, can the check valve or flutter valve open.

The invention will be better understood and further objects and advantages thereof will become more apparent from the ensuing detailed description of a preferred embodiment taken in conjunction with the drawing.

BRIEF DESCRIPTION OF THE DRAWING

The sole figure of the drawing is a schematic block circuit diagram of a fuel injection pump having a hydraulic final control element as an injection quantity governor.

DESCRIPTION OF THE PREFERRED EMBODIMENT

The exemplary embodiment shown in simplified form in the drawing includes the circulatory system of fuel for a fuel injection pump 10 for a Diesel engine, and an associated hydraulic final control element 11 for actuating a governor rod 12, represented by dot-dash lines, which in turn controls the fuel injection quantity metered per pump plunger stroke by the fuel injection pump 10. A suction chamber 13 of the fuel injection pump 10 is filled with fuel by an electrically driven feed pump 14, and fuel is aspirated from this chamber for injection upon each pump plunger stroke. The feed pump 14 mounted on the drive shaft of an electric motor 22 is connected on the intake side, via an intake line 15, with a fuel tank 16 and on the pressure side, via a pressure line 17, with the suction chamber 13. A fuel filter 18 and a check valve 19, the forward flow direction of which is toward the suction chamber 13 of the fuel injection pump 10, are disposed in the pressure line 17. The pressure line 17 is also connected via a check valve 20, having a blocking direction toward the pressure line 17, to a fuel return line 21.

The hydraulic final control element 11 has a control cylinder 23, in which a control piston 24 is axially displaceably guided. By means of a coupling rod 25, the control plunger 24 engages the governor rod 12 and with one plunger face defines a control chamber 26. On its plunger face remote from the control chamber 26, the control plunger is loaded by a restoring spring 27 supported in the control cylinder 23 and urging the control plunger 24 in the direction of minimum control chamber volume. The control chamber 26 communicates via an inlet 28 with a fuel reservoir 29 and via a return 30 with the fuel return line 21. The fuel reservoir 29 connected via a second pressure line 31 to the outlet of the fuel filter 18 has a spring-loaded diaphragm 32, which defines a reservoir chamber 33. When fuel is being fed by the feed pump 14, the reservoir chamber 33 is filled with fuel, causing the diaphragm 32 to recede, and thus putting the fuel reservoir 29 under pressure. Between the fuel filter 18 and the fuel reservoir 29, there is a check valve 34 the forward flow direction of which is toward the fuel reservoir 29.

A first switching valve 35, hereinafter called the inlet switching valve 35, is disposed in the inlet 28 to the control chamber 26 of the final control element 11, and a second switching valve 36, hereinafter the return switching valve 36, is disposed in the return 30 from the control chamber 26 to the fuel return line 21. Both switching valves 35, 36 are embodied as 2/2-way magnetic valves, the control inputs of which are connected to an electric control unit 37. The electric control unit 37 is supplied, via a signal line 42, with an actual-value signal that is representative of the quantity of fuel actually injected in the fuel injection pump 10. The control unit 37 calculates a set-point fuel injection quantity as a function of instantaneous parameters of the Diesel engine, and after comparison with the actual-value signal generates appropriate switching signals for the two switching valves 35, 36. Depending on the sign (+ or −) of the difference of the control deviation, the switching valve 35 or the switching valve 36 is triggered, preferably intermittently, so that the control plunger 24 is extended or retracted farther and thus adjusts the governor rod 12 in such a manner that the control deviation becomes zero. The supply voltage for the electric control unit 37 is drawn from a vehicle battery 43 and applied via the driving or ignition switch 44 to the electric control unit 37. The control unit 37 is also connected, via a signal line 46, to an emergency shutoff device 45, which in the event of a malfunction of the fuel injection pump responds to a persistent control deviation of the governor rod 12 and shuts off the electric motor 22. This persistent control deviation is supplied to the emergency shutoff device 45 by the control unit 37 in the form of a difference between the calculated set-point fuel injection quantity and the actual-value signal.

The control chamber 26 of the final control element 11 communicates via a connecting line 38 with the pressure-side outlet of the feed pump 14. A check valve 39 pre-stressed at approximately 0.5 bar is disposed in the connecting line 38. The blocking direction of the check valve 39 is toward the control chamber 26 of the control cylinder 23. Associated with the feed pump 14 is a bypass 40 having a bypass throttle 41, which connects the pressure side of the feed pump 14 with the fuel tank 16. A flutter valve may be inserted into the connecting line 38, instead of the check valve 39.

The mode of operation is as follows:

If the driving switch 44 is closed, then the supply of current to the electric control unit 37 and the electric motor 22 of the feed pump 14 is switched on. The feed pump 14 starts up, feeds fuel to open the check valve 19, which in turn allows the suction chamber 13 of the fuel injection pump 10 to be filled with fuel. Fuel also flows, opening the check valve 34, into the fuel reservoir 29 and puts it under pressure. The feed pressure in the connecting line 38 locks the check valve 39, so that fuel cannot flow out of the control chamber 26 of the final control element 11. In accordance with the set-point signal for injection quantity calculated on the basis of operating parameters, the inlet switching valve 35 is opened intermittently, and by means of the fuel flowing into the control chamber 26 from the fuel reservoir 29, the control plunger 24 is displaced to such an extent that the position of the governor rod 12 establishes an actual injection quantity in the fuel injection pump 10 which is equivalent to the calculated set-point injection quantity, so that there is no control deviation.

In the event of a malfunction, for instance if the triggering of the return switching valve 36 fails or the governor rod 12 sticks, the control deviation cannot be compensated for. Because of this persistent control deviation, the emergency shutoff device 45 responds and shuts off the electric motor 22. The feed pump 14 is thereby shut down, and fuel is no longer pumped. By the time several intake strokes of the plunger of the fuel injection pump 10 have been executed, the suction chamber 13 is partially empty, to such an extent that the engine stops from lack of fuel. Because of the disposition of the check valve 19 directly upstream of the suction chamber 13, only very small idle volumes are present, and so there are no notable additional volumes in the pressure line 17 that could delay the evacuation of the suction chamber 13. The absent feed pressure of the feed pump 14 also frees up the check valve 39 in the connecting line 38. This check valve 39 opens, and the fuel located in the control chamber 26 of the final control element 11 is capable of flowing back into the fuel tank 16 via the check valve 39 and the bypass throttle 41. The restoring spring 27 displaces the control plunger 24 toward the left as seen in the drawing, until the control chamber volume is minimal. Via the coupling rod 25, the governor rod 12 is shifted into its zero or stop position; the set injection quantity is now zero. If the fuel injection pump 10 communicates with a return line 47 leading to the fuel tank 16, as shown in the drawing, then a negative-pressure-tight overflow valve 48 must be provided at the outlet of the suction chamber 13, so that in the event of a malfunction, no fuel or air can be aspirated back into the suction chamber 13 from the return line 47.

The invention is not limited to the exemplary embodiment described above. For instance, instead of the hydraulic final control element 11, an electromagnetic or mechanical quantity control mechanism may be used. In these cases as well, the engine is shut off by means of the check valve 19 located upstream of the suction chamber 13 of the fuel injection pump 10 whenever the emergency shutoff device 45 responds as a consequence of a malfunction and shuts off the feed pump 14.

The foregoing relates to a preferred exemplary embodiment of the invention, it being understood that other variants and embodiments thereof are possible within the spirit and scope of the invention, the latter being defined by the appended claims.

What is claimed and desired to be secured by Letters patent of the United States is:

1. A fuel injection pump for internal combustion engines, in particular an in-line injection pump for Diesel engines, having a fuel quantity governor, an electrically driven feed pump communicating on an intake side with a fuel tank and communicating on a pressure side via a pressure line with a pump suction chamber for filling said suction chamber with fuel from the fuel tank, an emergency shutoff device adapted to respond to a malfunction in the governor, in particular to a persistent control deviation, by generating a switching signal, a check valve (19) having a forward flow direction oriented toward the suction chamber (13) being disposed in the pressure line (17) between the feed pump (14) and the suction chamber (13), the switching signal of the emergency shutoff device (45) triggering a shutoff of the feed pump drive (22).

2. An injection pump as defined by claim 1, in which the check valve (19) is disposed spatially directly upstream of the suction chamber (13).

3. An injection pump as defined by claim 1, in which the governor has a hydraulic final control element (11) for actuating a governor member (12) controlling the fuel injection quantity, said final control element having a control plunger (24) displaceable in a control cylinder (23), said control plunger (24) defining a control chamber (26) and being urged by a restoring spring (27) in a displacement direction to reduce a control chamber volume thereof, said final control element further having first and second electric switching valves (35, 36) controllable by means of an electric valve control unit (37), said first switching valve being disposed in an fuel inlet line (28) communicating with a pressurized fuel reservoir (29), and leading to the control chamber (26), said second switching valve being disposed in a fuel return line (21) communicating with the fuel tank (16) and leading from the control chamber (26), the pressurized fuel reservoir (29) being connected, via a check valve (34) having a forward flow direction toward the fuel reservoir (29), to the pressure-side outlet of the feed pump (14).

4. An injection pump as defined by claim 2, in which the governor has a hydraulic final control element (11) for actuating a governor member (12) controlling the fuel injection quantity, said final control element having a control plunger (24) displaceable in a control cylinder (23), said control plunger (24) defining a control chamber (26) and being urged by a restoring spring (27) in a displacement direction to reduce a control chamber volume thereof, said final control element further having first and second electric switching valves (35, 36) controllable by means of an electric valve control unit (37), said first switching valve being disposed in an fuel inlet line (28) communicating with a pressurized fuel reservoir (29), and leading to the control chamber (26), said second switching valve being disposed in a fuel return line (21) communicating with the fuel tank (16) and leading from the control chamber (26), the pressurized fuel reservoir (29) being connected, via a check valve (34) having a forward flow direction toward the fuel reservoir (29), to the pressure-side outlet of the feed pump (14).

5. An injection pump as defined by claim 3, in which the control chamber (26) of the final control element (11) communicates via a connecting line (38) with the pressure-side connection of the feed pump (14), the feed pump communicates via a bypass (40) having a bypass throttle (41) with the fuel tank (16), and a valve means (39) having a blocking direction oriented toward the control chamber (26) is disposed in the connecting line (38).

6. An injection pump as defined by claim 4, in which the control chamber (26) of the final control element (11) communicates via a connecting line (38) with the pressure-side connection of the feed pump (14), the feed pump communicates via a bypass (40) having a bypass throttle (41) with the fuel tank (16), and a valve means (39) having a blocking direction oriented toward the control chamber (26) is disposed in the connecting line (38).

7. An injection pump as defined by claim 5, in which said valve means comprises a check valve.

8. An injection pump as defined by claim 5, in which said valve means is a flutter valve.

9. An injection pump as defined by claim 6, in which said avle means comprises a check valve.

10. An injection pump as defined by claim 6, in which said valve means is a flutter valve.

* * * * *